US006152107A

United States Patent [19]

Barnes et al.

[11] Patent Number: 6,152,107

[45] Date of Patent: Nov. 28, 2000

[54] DEVICE FOR CONTROLLING FUEL INJECTION IN COLD ENGINE TEMPERATURES

[75] Inventors: Travis E. Barnes, Loveland, Colo.; Michael S. Lukich, Chillicothe, Ill.

[73] Assignee: Caterpillar Inc., Peoria, Ill.

[21] Appl. No.: 09/138,887

[22] Filed: Aug. 24, 1998

[51] Int. Cl.[7] ..... F02D 31/00

[52] U.S. Cl. ..... 123/357; 123/179.17; 123/383; 123/446

[58] Field of Search ..... 123/357, 179.17, 123/358, 359, 381, 383

[56] References Cited

U.S. PATENT DOCUMENTS

| | | | |
|---|---|---|---|
| 4,368,705 | 1/1983 | Stevenson | 123/357 |
| 4,444,168 | 4/1984 | Matsumura et al. . | |
| 4,566,414 | 1/1986 | Sieber | 123/357 |
| 4,619,234 | 10/1986 | Okamoto | 123/357 |
| 4,730,586 | 3/1988 | Yamaguchi | 123/357 |
| 4,844,035 | 7/1989 | Takagi | 123/357 |
| 5,176,115 | 1/1993 | Campion | 123/381 |
| 5,181,494 | 1/1993 | Ausman | 123/179.17 |
| 5,357,912 | 10/1994 | Barnes | 123/357 |
| 5,445,129 | 8/1995 | Barnes | 123/179.17 |
| 5,529,044 | 6/1996 | Barnes et al. | 123/496 |
| 5,572,964 | 11/1996 | Cogneville | 123/179.17 |
| 5,586,538 | 12/1996 | Barnes | 123/446 |
| 5,613,474 | 3/1997 | Nakamura | 123/179.17 |

FOREIGN PATENT DOCUMENTS

| | | |
|---|---|---|
| 0742362A2 | 5/1996 | European Pat. Off. . |
| 59063333 | 4/1984 | Japan . |
| 2266168 | 4/1984 | United Kingdom . |
| 2167881 | 11/1985 | United Kingdom . |
| 91/03637 | 8/1990 | WIPO . |

*Primary Examiner*—Carl S. Miller
*Attorney, Agent, or Firm*—Haverstock Garrett & Roberts

[57] ABSTRACT

The present invention is an apparatus for controlling the amount of fuel delivered to an engine during operation at cold and warm temperatures using different sets of fuel rate maps designed to compensate fuel quantity signals to optimize engine performance. A switching mechanism based on engine coolant temperature is used to select which set of maps to use. When the engine coolant temperature is below a threshold level, a cold torque map provides a signal representing the duration limit of time that fuel is to be injected. A compensating factor derived from a cold temperature smoke map is used to adjust the cold torque map signal to limit the fuel amount to prevent excess smoke. When the engine coolant temperature is above the threshold, a fuel duration limit signal from a standard temperature torque map is compared to a fuel duration limit signal from a standard temperature smoke map, and the minimum between the two signals is selected for output to the fuel injectors.

10 Claims, 6 Drawing Sheets

Fig. 3

COOLANT TEMP. 1

| INJECTION ACTUATION PRESSURE / ENGINE SPEED | ENGINE SPEED 1 | ENGINE SPEED 2 | ENGINE SPEED 3 |
|---|---|---|---|
| INJECTION ACTUATION PRESSURE 1 | STANDARD FUEL QUANTITY | STANDARD FUEL QUANTITY | STANDARD FUEL QUANTITY |
| INJECTION ACTUATION PRESSURE 2 | STANDARD FUEL QUANTITY | STANDARD FUEL QUANTITY | STANDARD FUEL QUANTITY |
| INJECTION ACTUATION PRESSURE 3 | STANDARD FUEL QUANTITY | STANDARD FUEL QUANTITY | STANDARD FUEL QUANTITY |

COOLANT TEMP. 2

| INJECTION ACTUATION PRESSURE / ENGINE SPEED | ENGINE SPEED 1 | ENGINE SPEED 2 | ENGINE SPEED 3 |
|---|---|---|---|
| INJECTION ACTUATION PRESSURE 1 | STANDARD FUEL QUANTITY | STANDARD FUEL QUANTITY | STANDARD FUEL QUANTITY |
| INJECTION ACTUATION PRESSURE 2 | STANDARD FUEL QUANTITY | STANDARD FUEL QUANTITY | STANDARD FUEL QUANTITY |
| INJECTION ACTUATION PRESSURE 3 | STANDARD FUEL QUANTITY | STANDARD FUEL QUANTITY | STANDARD FUEL QUANTITY |

COOLANT TEMP. 3

| INJECTION ACTUATION PRESSURE / ENGINE SPEED | ENGINE SPEED 1 | ENGINE SPEED 2 | ENGINE SPEED 3 |
|---|---|---|---|
| INJECTION ACTUATION PRESSURE 1 | STANDARD FUEL QUANTITY | STANDARD FUEL QUANTITY | STANDARD FUEL QUANTITY |
| INJECTION ACTUATION PRESSURE 2 | STANDARD FUEL QUANTITY | STANDARD FUEL QUANTITY | STANDARD FUEL QUANTITY |
| INJECTION ACTUATION PRESSURE 3 | STANDARD FUEL QUANTITY | STANDARD FUEL QUANTITY | STANDARD FUEL QUANTITY |

Fig. 4

COOLANT TEMP. 1

| INJECTION ACTUATION PRESSURE / ENGINE SPEED | ENGINE SPEED 1 | ENGINE SPEED 2 | ENGINE SPEED 3 |
|---|---|---|---|
| INJECTION ACTUATION PRESSURE 1 | COLD FUEL QUANTITY | COLD FUEL QUANTITY | COLD FUEL QUANTITY |
| INJECTION ACTUATION PRESSURE 2 | COLD FUEL QUANTITY | COLD FUEL QUANTITY | COLD FUEL QUANTITY |
| INJECTION ACTUATION PRESSURE 3 | COLD FUEL QUANTITY | COLD FUEL QUANTITY | COLD FUEL QUANTITY |

COOLANT TEMP. 2

| INJECTION ACTUATION PRESSURE / ENGINE SPEED | ENGINE SPEED 1 | ENGINE SPEED 2 | ENGINE SPEED 3 |
|---|---|---|---|
| INJECTION ACTUATION PRESSURE 1 | COLD FUEL QUANTITY | COLD FUEL QUANTITY | COLD FUEL QUANTITY |
| INJECTION ACTUATION PRESSURE 2 | COLD FUEL QUANTITY | COLD FUEL QUANTITY | COLD FUEL QUANTITY |
| INJECTION ACTUATION PRESSURE 3 | COLD FUEL QUANTITY | COLD FUEL QUANTITY | COLD FUEL QUANTITY |

COOLANT TEMP. 3

| INJECTION ACTUATION PRESSURE / ENGINE SPEED | ENGINE SPEED 1 | ENGINE SPEED 2 | ENGINE SPEED 3 |
|---|---|---|---|
| INJECTION ACTUATION PRESSURE 1 | COLD FUEL QUANTITY | COLD FUEL QUANTITY | COLD FUEL QUANTITY |
| INJECTION ACTUATION PRESSURE 2 | COLD FUEL QUANTITY | COLD FUEL QUANTITY | COLD FUEL QUANTITY |
| INJECTION ACTUATION PRESSURE 3 | COLD FUEL QUANTITY | COLD FUEL QUANTITY | COLD FUEL QUANTITY |

DEVICE FOR CONTROLLING FUEL INJECTION IN COLD ENGINE TEMPERATURES

TECHNICAL FIELD

The present invention relates generally to a device for controlling fuel injection and, more particularly, to the use of two different engine maps for controlling the amount of fuel delivered to a cold engine.

BACKGROUND

An internal combustion engine may operate in a variety of different modes, particularly in modern engine systems, which are electronically controlled, based upon a variety of monitored engine operating parameters. Some typical operating modes include a cold mode, a warm mode, a cranking mode, a low idle mode, a high idle mode, and an in-between mode which is between the low idle mode and the high idle mode. Various engine operating parameters may be monitored to determine the engine operating mode including engine speed, throttle position, vehicle speed, coolant temperature, and oil temperature, as well as others. In each operating mode it is not uncommon to use different techniques to determine the amount of fuel to deliver to the engine for a fuel delivery cycle. For example, different fuel rate maps might be utilized in two different modes or a fuel rate map might be used in one mode and in another mode an engine speed governor with closed loop control may be used. One of these maps is a torque map which uses the actual engine speed signal to produce the maximum allowable fuel quantity signal based on the horsepower and torque characteristics of the engine. Another map is the emissions, or smoke limiter map, which limits the amount of smoke produced by the engine as a function of air manifold pressure or boost pressure, ambient temperature and pressure, and engine speed. The maximum allowable fuel quantity signal produced by the smoke map limits the quantity of fuel based on the quantity of air available to prevent excess smoke.

Known hydraulically-actuated fuel injector systems that use smoke maps and torque maps are shown, for example, in U.S. Pat. No. 5,586,538. Such systems utilize an electronic control module that regulates the quantity of fuel that the fuel injector dispenses. The electronic control modules include software in the form of maps or multi-dimensional data tables that are used to define optimum fuel system operational parameters to regulate the quantity of fuel that the fuel injector dispenses, such as the torque map and smoke map discussed hereinabove. However, such lookup tables are typically developed in response to a predetermined engine temperature. Consequently, when the engine temperature deviates from the predetermined engine temperature, the actuating fluid viscosity changes which causes the fuel injectors to dispense a greater or lesser amount of fuel than that desired. For example, a torque map designed for use once the engine has reached warm operating temperatures will not deliver enough fuel to generate the desired power in cold operating conditions.

Accordingly, the present invention is directed to overcoming one or more of the problems as set forth above.

DISCLOSURE OF THE INVENTION

The present invention is an apparatus for controlling the amount of fuel delivered to an engine during operation at cold and warm temperatures using different sets of fuel rate maps designed to compensate fuel quantity signals to optimize engine performance. A switching mechanism based on engine coolant temperature is used to select which set of maps to use. When the engine coolant temperature is below a threshold level, a cold torque map provides a signal representing the duration limit of time that fuel is to be injected. A compensating factor derived from a cold temperature smoke map is used to adjust the cold torque map signal to limit the fuel amount to prevent excess smoke. When the engine coolant temperature is above the threshold, a fuel duration limit signal from a standard temperature torque map is compared to a fuel duration limit signal from a standard temperature smoke map, and the minimum between the two signals is selected for output to the fuel injectors.

BRIEF DESCRIPTION OF DRAWINGS

FIG. 3 is a data table representing a standard torque map;

FIG. 4 is a data table representing a cold torque map; and

BEST MODE FOR CARRYING OUT THE INVENTION

Figure 1:
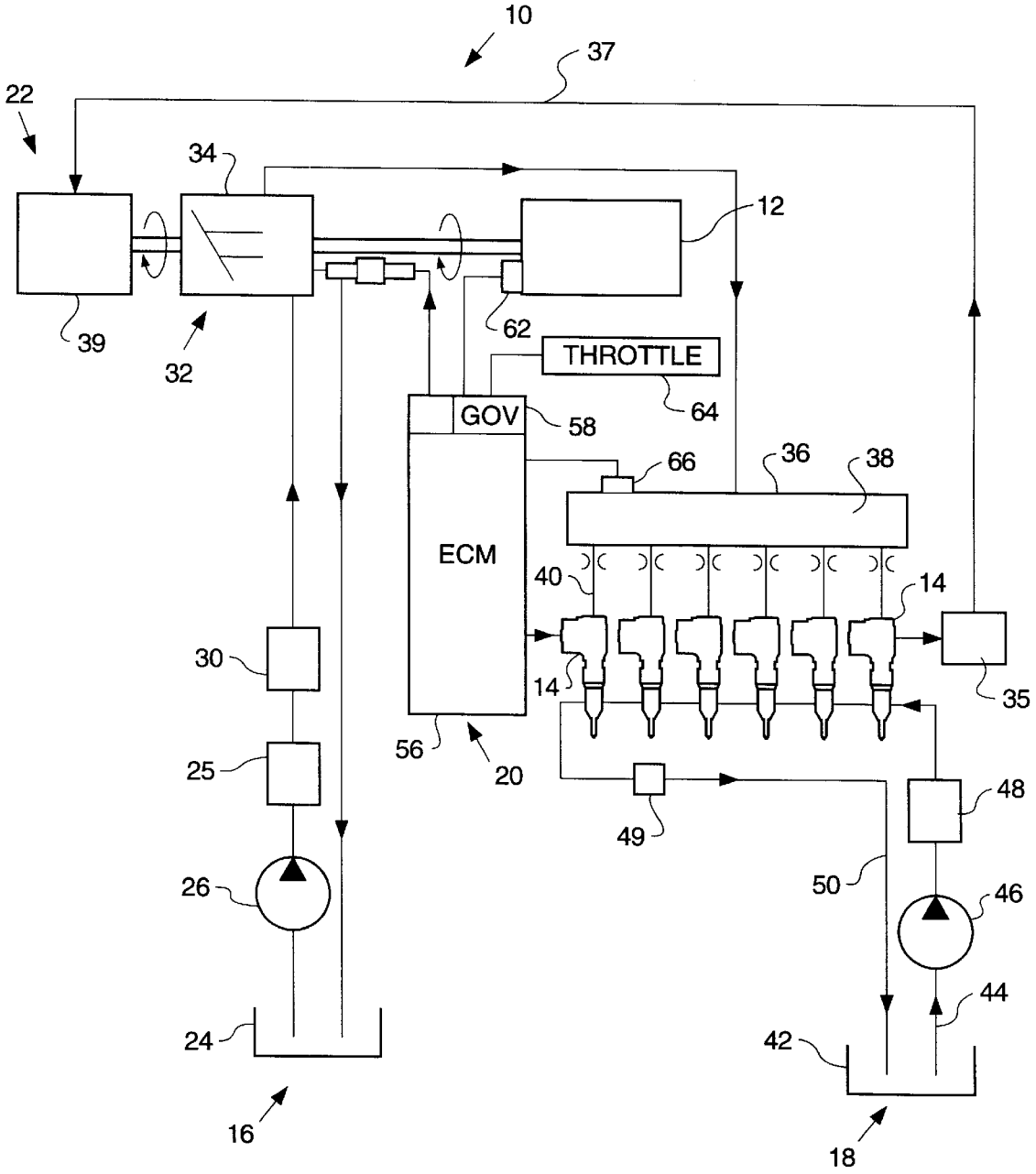
FIG. 1 is a diagram of the components of a hydraulically actuated electronically controlled injector fuel system for an engine having a plurality of fuel injectors.

Throughout the specification and figures, like reference numerals refer to like components or parts. Referring to FIG. 1, there is shown a hydraulically actuated electronically controlled fuel injector system 10 (hereinafter referred to as HEUI fuel system). Typical of such systems are those shown and described in U.S. Pat. No. 5,463,996, U.S. Pat. No. 5,669,355, U.S. Pat. No. 5,673,669, U.S. Pat. No. 5,687,693, and U.S. Pat. No. 5,697,342. The exemplary HEUI fuel system is shown in FIG. 1 as adapted for a direct-injection diesel-cycle internal combustion engine 12.

HEUI fuel system 10 includes one or more hydraulically actuated electronically controlled injectors 14, such as unit fuel injectors, each adapted to be positioned in a respective cylinder head bore of engine 12. The system 10 further includes apparatus or means 16 for supplying hydraulic actuating fluid to each injector 14, apparatus or means 18 for supplying fuel to each injector, apparatus or means 20 for electronically controlling the manner in which fuel is injected by injectors 14, including timing, number of injections, and injection profile, and actuating fluid pressure of the HEUI fuel system 10 independent of engine speed and load. Apparatus or means 22 for re-circulating or recovering hydraulic energy of the hydraulic actuating fluid supplied to injectors 14 is also provided.

Hydraulic actuating fluid supply means 16 preferably includes an actuating fluid sump 24, a relatively low pressure actuating fluid transfer pump 26, an actuating fluid cooler 25, one or more actuating fluid filters 30, a source or means 32 for generating relatively high pressure actuating fluid, such as a relatively high pressure actuating fluid pump 34, and at least one relatively high pressure fluid manifold 36. The actuating fluid is preferably engine lubricating oil. Alternatively, the actuating fluid could be fuel. Apparatus 22 may include a waste actuating fluid control valve 35 for each injector, a common re-circulation line 37, and a hydraulic motor 39 connected between the actuating fluid pump 34 and re-circulation line 37.

Actuating fluid manifold 36, associated with injectors 14, includes a common rail passage 38 and a plurality of rail branch passages 40 extending from common rail 38 and arranged in fluid communication between common rail 38 and actuating fluid inlets of respective injectors 14. Common rail passage 38 is also arranged in fluid communication with the outlet from high pressure actuating fluid pump 34.

Fuel supplying means 18 includes a fuel tank 42, a fuel supply passage 44 arranged in fluid communication between fuel tank 42 and a fuel inlet of each injector 14, a relatively low pressure fuel transfer pump 46, one or more fuel filters 48, a fuel supply regulating valve 49, and a fuel circulation and return passage 50 arranged in fluid communication between injectors 14 and fuel tank 42. The various fuel passages may be provided in a manner commonly known in the art.

Electronic controlling means 20 preferably includes an electronic control module (ECM) 56, the use of which is well known in the art. The ECM 56 in the present invention includes processing means such as a microcontroller or microprocessor, an engine speed governor 58 such as a proportional-integral-differential (PID) controller that regulate fuel quantity, and circuitry including input/output circuitry and the like. The ECM 56 also uses engine maps to regulate the amount of fuel injected in the engine. The term "map", as used herein, refers to a multi-dimensional data table from which data may be extracted using a software-implemented table look-up routine, as is well known in the art. Such engine maps may include torque maps, smoke maps, or any other type of map that may be used to control fuel injection timing, fuel quantity injected, fuel injection pressure, number of separate injections per injection cycle, time intervals between injection segments, and fuel quantity injected by each injection segment. Each of such parameters are variably controllable independent of engine speed and load.

Associated with a camshaft of engine 12 is an engine speed sensor 62 which produces speed indicative signals. Engine speed sensor 62 is connected to the governor 58 of ECM 56 for monitoring the engine speed and piston position for timing purposes. A throttle 64 is also provided and produces signals indicative of a desired engine speed, or alternatively, fuel quantity to the engine, throttle 64 also being connected to the governor 58 of ECM 56. An actuating fluid pressure sensor 66 for sensing the pressure within common rail 38 and producing pressure indicative signals is also connected to ECM 56.

Each of the injectors 14 is preferably of a type such as that shown and described in one of U.S. Pat. No. 5,463,996, U.S. Pat. No. 5,669,355, U.S. Pat. No. 5,673,669, U.S. Pat. No. 5,687,693, and U.S. Pat. No. 5,697,342. However, it is recognized that the present invention could be utilized in association with other variations of hydraulically actuated electronically controlled injectors.

Figure 2:
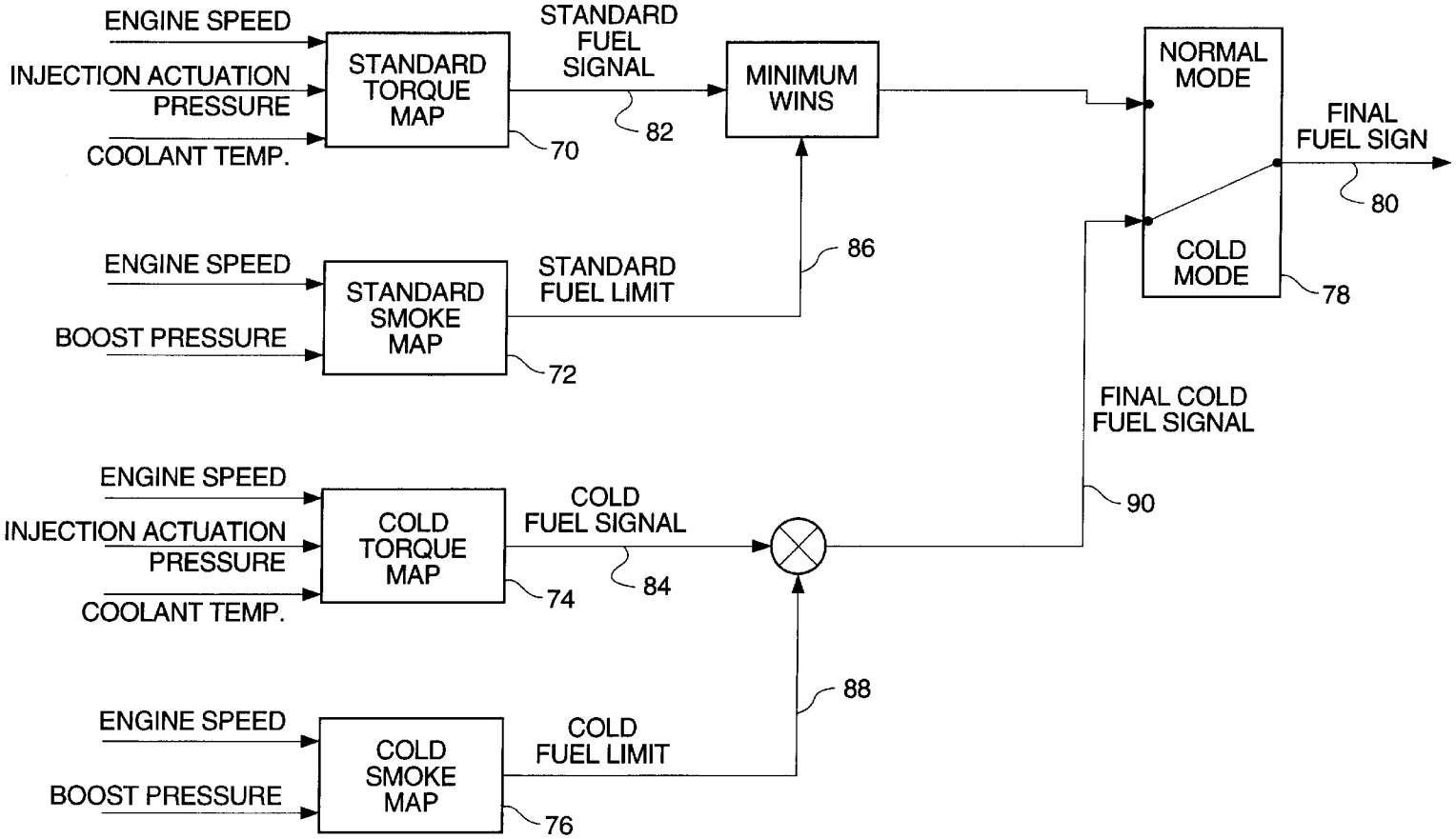
FIG. 2 is a block diagram view of the present invention for controlling fuel quantity to an engine using different sets of fuel maps.

FIG. 2 shows a functional block diagram of the present invention for controlling fuel injection in an engine using standard engine maps, such as a standard torque map 70 and standard smoke map 72 which are designed for use when the engine coolant temperature is warm, and cold engine maps, such as cold torque map 74 and cold smoke map 76, which are used at cold engine coolant temperatures. A switching mechanism 78 is included to control whether the standard or the cold maps are used to supply a signal representing a final fuel signal 80 which is the amount of fuel to be delivered to the ECM 56. The switching mechanism 78 may be implemented in software so that it is executed prior to executing the table look-up routines for the maps, and then only executing the table look-up routines associated with the selected maps. This would reduce the amount of processing time that would be required if the table look-up routines for both sets of maps were executed. The switching mechanism 78 sets a variable that indicates whether the standard maps 70, 72, or the cold maps 74, 76 are used based on a threshold temperature value. The threshold temperature value may be a constant or a variable. Further, means for preventing the switch from toggling back and forth between cold and standard maps may be used, such as a hysteresis gap between the standard temperature threshold value and the cold temperature threshold value. For example, the standard temperature threshold value may be set to 19 degrees Celsius while the cold temperature threshold value may be set to 17 degrees Celsius.

Torque maps 70, 74 and smoke maps 72, 76 that are a function of engine temperature along with a variety of other different variables may be used in the present invention. FIGS. 2, 3, and 4 show examples of torque maps 70, 74 that are functions of engine speed, injection actuation pressure, and coolant temperature, however, the present invention may be used with other maps that provide data representing the desired fuel quantity to be delivered as a function of engine temperature alone, or one or more additional variables such as engine speed, injection actuation pressure, and/or throttle position. The torque maps shown in FIGS. 2, 3, and 4 are shown as functions of engine temperature, injection actuation pressure, and engine speed for illustrative purposes and are not meant to limit the present invention to use of functions that are dependent on those variables exclusively. Further, the standard torque map 70 and the cold torque map 74 do not have to be dependent on the same variables in the same embodiment of the present invention. For example, the standard torque map 70 may be a function of injection actuation pressure, engine speed, and engine coolant temperature, while the cold torque map 74 may be a function of engine temperature and throttle position. In FIGS. 3 and 4, the example torque maps 70, 74 contain a plurality of coolant temperature curves, each temperature curve having a plurality of curves that correspond to an actual engine speed and injection actuation pressure. In these example curves, a signal representative of the desired fuel quantity is determined based on the values for the coolant temperature, injection actuation pressure, and engine speed signals. The representative value of the desired fuel quantity may, for example, be a duration signal such as crank degrees indicating the amount of time the injectors 14 should inject fuel in the engine, or alternatively, a fuel quantity signal indicating the quantity of fuel to deliver. A standard fuel signal 82 is produced for use during normal operation, and a cold fuel signal 84 is produced from the cold torque map 74 when the engine is operating in cold engine temperatures. The cold torque maps are developed by operating the engine with a selected weight of oil at approximately maximum pump load and half pump load from a cold temperature such as −28 degrees Celsius to warm, or normal, mode. The test is repeated for different injection actuation pressures. An approximate equation for the cold fuel signal 84 at a given injection actuation pressure can be determined from the slope and offset of a line drawn through the two test points at the given injection actuation pressure. This data can then be used to determine the values for the cold torque map 74.

Figure 5:
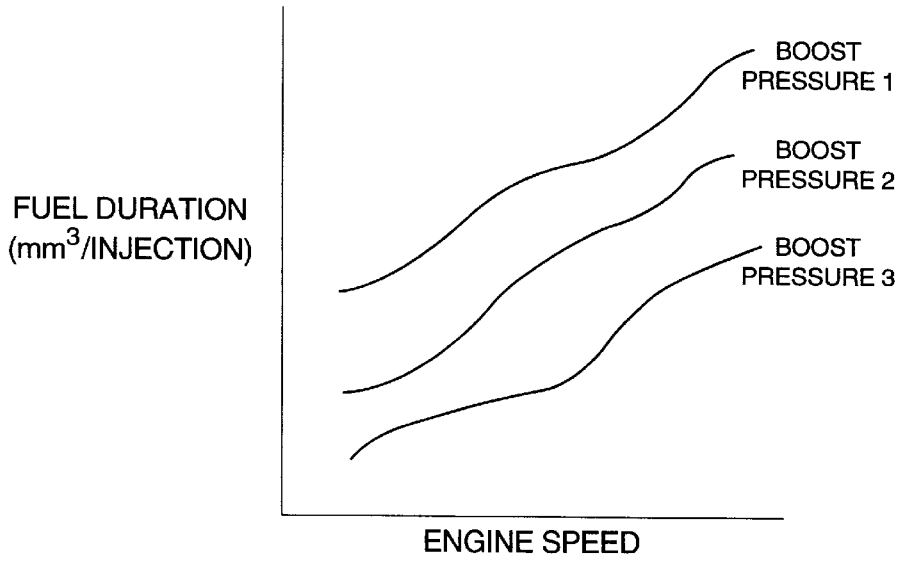
FIG. 5 is a graph of an example of smoke map as used in the normal mode of the present invention.
Figure 6:
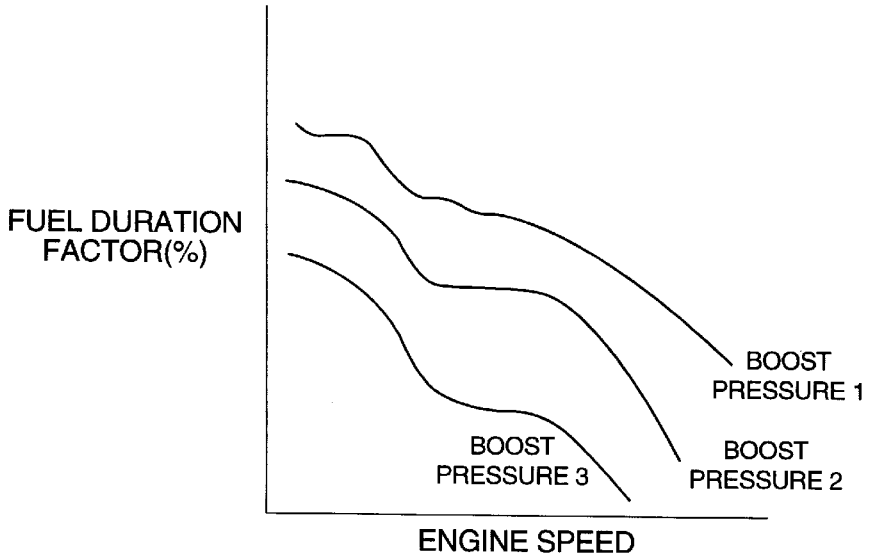
FIG. 6 is a graph of an example of a smoke map used in the cold mode of the present invention.

Independent of whether the standard or cold maps are selected, fuel limit signals 86, 88 may be generated using emission limiters or smoke maps 72, 76 to limit the amount of smoke produced by the engine. The smoke maps 72, 76 may be functions of several possible input variables including, but not limited to: an air inlet pressure signal indicative of, for example, air manifold pressure or boost pressure, an ambient pressure signal, an ambient temperature signal, and/or an engine speed signal. The fuel limit signals 86, 88 limit the quantity of fuel delivered based on the quantity of air available to prevent excess smoke. The value derived from the smoke maps 72, 76 may represent the amount of fuel to deliver, or, alternatively, the value may be a factor that is multiplied with the fuel signal, such as standard fuel signal 82 or cold fuel signal 84. FIGS. 5 and 6 show examples of smoke maps containing curves that are a function of actual engine speed and boost pressure. The curves shown in FIG. 5 output a signal representative of the desired fuel quantity, while the curves in FIG. 6 output a percentage that is applied to the output of the cold torque map 74 to obtain a final cold fuel signal 90.

FIG. 2 shows an embodiment wherein the standard fuel limit signal 86 is compared to the standard fuel signal 82, and the minimum signal between them is selected for output to the ECM 56 as the final fuel signal 80 when the engine temperature is running above the threshold temperature, or in normal mode. FIG. 2 also shows the cold fuel limit signal 88 as a factor that is multiplied with the cold fuel signal 84 to form the final fuel signal 80 when the engine temperature is below the threshold temperature, or in cold mode. Note that although two maps 70, 72 are shown for illustrative purposes, it may be apparent to those skilled in the art that other such maps may be employed. The values provided in the maps are dictated by the performance characteristics of the particular engine being used.

INDUSTRIAL APPLICABILITY

Figure 7:
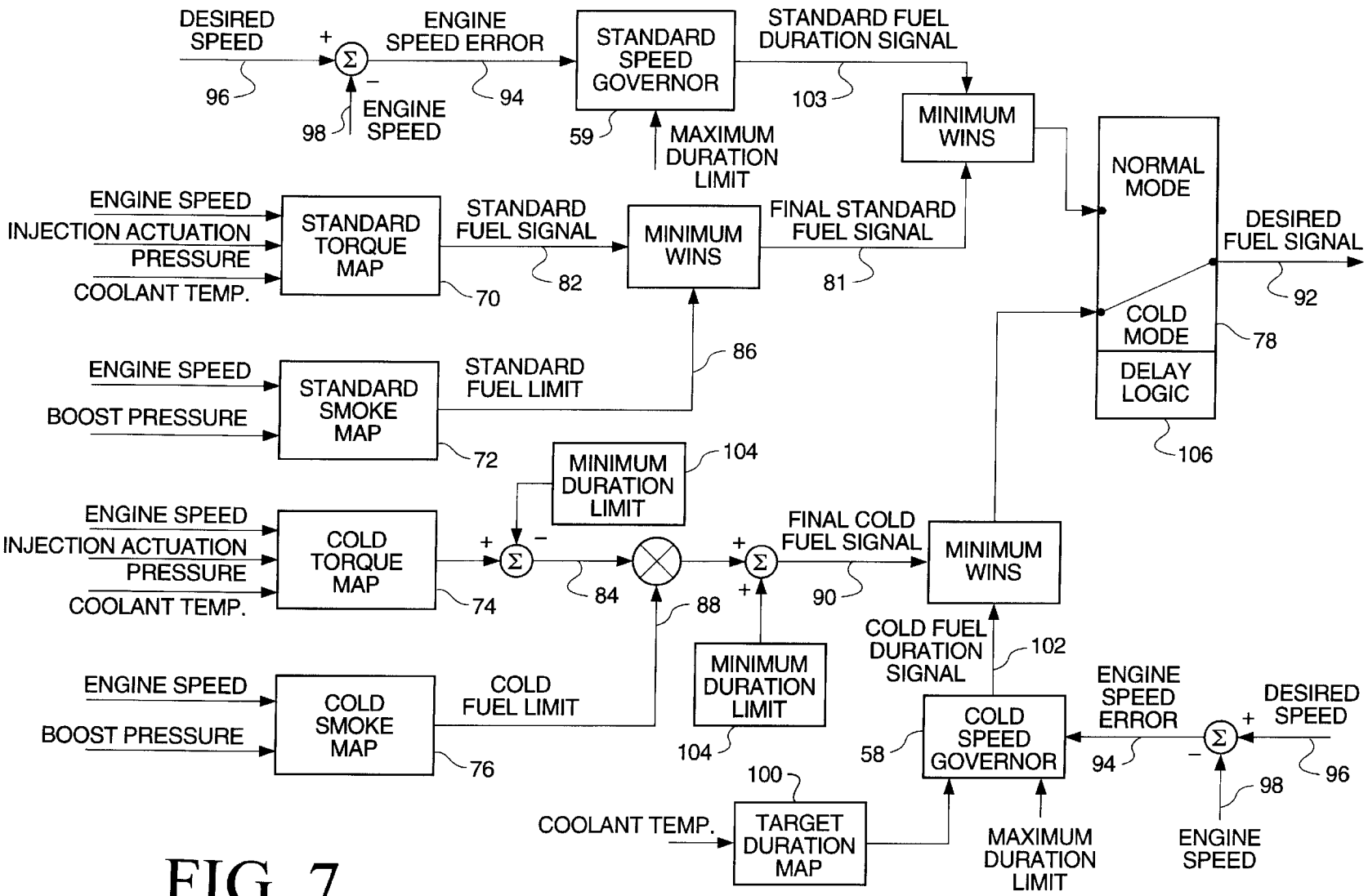
FIG. 7 is a block diagram of the present invention coupled with a standard speed governor and a cold mode speed governor for controlling the amount of fuel delivered to the engine.

Using different maps for cold mode operation and normal mode operation provides for better engine performance during a greater range of engine operating conditions. FIG. 7 shows an example of how the present invention may be integrated with a standard speed governor 59 and a cold mode speed governor 58 to provide a desired fuel signal 92 to the ECM 56. An engine speed error signal 94 representing the difference between the desired engine speed 96 and the actual engine speed 98 is input to both the standard speed governor 59 and the cold mode speed governor 58, which are typically implemented as proportional-integral control law as is well known in the art. The standard speed governor 59 outputs a standard fuel duration signal 103 that is compared to a final standard fuel signal 81 output from the standard torque map 70 and the standard smoke map 72, when the engine is operating in the normal mode. A desired fuel signal 92 is formed by taking the minimum value between the standard fuel duration signal 103 and the final standard fuel signal 81 when the engine is operating in the normal mode.

FIG. 7 shows additional logic that may be implemented in the cold mode portion of the block diagram. Specifically, there is a minimum duration limit 104 that is required to inject fuel in the engine. It is undesirable to let the desired fuel signal 92 fall below the minimum duration limit 104. This is because a dead band in fuel delivered to the engine will result and no fuel will be delivered to the engine until the desired fuel signal 92 is brought back up to the minimum value. The minimum duration limit 104 is a function of injection actuation pressure and engine coolant temperature. The cold fuel signal 84 is formed by subtracting the minimum duration limit 104 from the output of the cold torque map 74. The final cold fuel signal 90 is formed by multiplying the cold fuel signal 84 by the cold fuel limit 88 factor and adding back in the signal from the minimum duration limit 104.

A target duration map 100 may also be used by the cold speed governor 58 to determine the injection actuation pressure that will maintain injector crank duration at a target crank duration value. This may be used to control the amount of white smoke produced by the engine during operation in the cold mode. The values in the target duration map 100 are a function of coolant temperature and are determined by testing various oil grades across the engine operating temperature range.

During cold mode operation, the final cold fuel signal 90 is limited by the cold mode torque map 74 and the duration limit 104. The cold torque map 74 is developed using a running engine. The oil in the rail of a running engine passes through the high pressure pump 32 and is sheared down to a lower viscosity than the oil entering the pump. There is a volume of oil that is present in the rail immediately after the engine starts that is used to drive the injectors. This volume of oil is not sheared down by the high pressure pump. Due to the presence of the unsheared oil, the limit from cold torque map 74 may be too restrictive for several seconds after the engine has first started. To overcome the initial startup problem, delay logic 106 may be implemented so that the output from the cold torque map 74 is not used for several seconds after the engine has first started. After the cold fuel duration signal 102 is below the final cold fuel signal 90 for a predetermined number of seconds, or the engine has been running for 30 seconds, the delay logic 106 allows the output from the cold smoke map 76 to be used.

Other aspects, objects and advantages of the present invention can be obtained from a study of the drawings, the disclosure and the appended claims.

What is claimed is:

1. An apparatus for determining an amount of fuel to be injected into an engine, comprising:

a first processing device operable to receive a first signal indicative of an engine speed, a second signal indicative of an engine injection actuation pressure, and a third signal indicative of an engine coolant temperature, the first processing device operable to transmit a fourth signal as a function of the first, second, and third signals, the fourth signal being indicative of a first desired amount of fuel to be injected into the engine when the engine is operating in a cold mode; and a second processing device operable to receive the first signal and a fifth signal indicative of a boost pressure of the engine, the second processing device operable to transmit a sixth signal as a function of the first and fifth signals, the sixth signal being indicative of a desired scaling factor; and a third processing device coupled with the first and second processing devices to respectively receive the fourth and sixth signals, the third processing device operable to transmit a seventh signal as a function of the product of the fourth and sixth signals, the seventh signal being indicative of a second desired amount of fuel to be injected into the engine when the engine is operating in the cold mode.

2. The apparatus of claim 1 wherein the first processing device comprises a cold torque map.

3. The apparatus of claim 1 wherein the second processing device comprises a cold smoke map.

4. The apparatus of claim 1 wherein the sixth signal is proportional to the fifth signal.

5. The apparatus of claim 1 wherein the engine is operating in the cold mode when the coolant temperature is below a predetermined temperature.

6. The apparatus of claim 1, further comprising:

a fourth processing device operable to receive the first and second signals, and operable to transmit an eighth signal as a function of the first and second signals, the eighth signal being indicative of a third desired amount of fuel to be injected into the engine when the engine is operating in a standard mode;

a fifth processing device operable to receive the first and fifth signals, the fifth processing device operable to transmit a ninth signal as a function of the first and fifth signals, the ninth signal being indicative of a fourth desired amount of fuel to be injected into the engine when the engine is operating in the standard mode;

a sixth processing device coupled with the fourth and fifth processing devices to respectively receive the eighth and ninth signals, the sixth processing device operable to transmit a tenth signal as a function of one of the eighth and ninth signals, the tenth signal being indicative of a fifth desired amount of fuel to be injected into the engine when the engine is operating in the standard mode;

a seventh processing device operable to receive the third signal and coupled with the third processing device to receive the seventh signal and with the sixth processing device to receive the tenth signal, the seventh processing device operable to transmit one of the seventh and tenth signals as a function of the third signal.

7. The apparatus of claim 6 wherein the tenth signal comprises the lesser of the eighth and ninth signals.

8. The apparatus of claim 6 wherein the seventh processing device transmits the seventh signal when the third signal is above a first predetermined threshold and transmits the tenth signal when the third signal is below a second predetermined threshold.

9. A method for determining an amount of fuel to be injected into an engine, comprising:

receiving a first signal indicative of an engine speed;

receiving a second signal indicative of an injection actuation pressure of the engine;

receiving a third signal indicative of a coolant temperature of the engine;

receiving a fourth signal indicative of a boost pressure of the engine;

determining a first fuel amount as a function of the first, second, and third signals;

determining a scaling factor as a function of the first and fourth signals; and multiplying the first fuel amount by the scaling factor, the desired amount of fuel to be injected into the engine when the engine is operating in cold mode comprising the product of the first fuel amount and the scaling factor.

10. A method for determining an amount of fuel to be injected into an engine, comprising:

receiving a first signal indicative of an engine speed;

receiving a second signal indicative of an injection actuation pressure of the engine;

receiving a third signal indicative of a coolant temperature of the engine;

receiving a fourth signal indicative of a boost pressure of the engine;

determining and transmitting a fifth signal indicative of a desired amount of fuel to be injected into the engine when the engine is operating in a cold mode, the fifth signal being a function of the first, second, third, and fourth signals, wherein the engine is operating in a cold mode when the coolant temperature is below a predetermined temperature.

* * * * *